US006805386B2

(12) United States Patent
Ehret et al.

(10) Patent No.: US 6,805,386 B2
(45) Date of Patent: Oct. 19, 2004

(54) DOOR LOCK HAVING A CLOSING AID

(75) Inventors: Jürgen Ehret, Weinheim (DE); Michael Helmer, Schwalbach (DE)

(73) Assignee: Siemens Aktiengesellschaft, München (DE)

( * ) Notice: Subject to any disclaimer, the term of this patent is extended or adjusted under 35 U.S.C. 154(b) by 0 days.

(21) Appl. No.: 10/025,197

(22) Filed: Dec. 19, 2001

(65) Prior Publication Data

US 2002/0093207 A1 Jul. 18, 2002

(30) Foreign Application Priority Data

Dec. 23, 2000 (DE) ..... 100 64 914

(51) Int. Cl.[7] ..... E05C 3/16

(52) U.S. Cl. ..... 292/216; 292/201; 292/DIG. 23; 292/28; 292/50; 292/141

(58) Field of Search ..... 292/201, 216, 292/DIG. 23, 28, 38, 50, 84, 125, 171, 141, 225, 235

(56) References Cited

U.S. PATENT DOCUMENTS

| | | | | | |
|---|---|---|---|---|---|
| 3,924,427 | A | | 12/1975 | Juaquin | |
| 4,575,138 | A | * | 3/1986 | Nakamura et al. | 292/216 |
| 5,273,324 | A | * | 12/1993 | Kobayashi | 292/201 |
| 5,520,425 | A | * | 5/1996 | Dowling | 292/201 |
| 5,549,337 | A | * | 8/1996 | McCulloch | 292/225 |
| 5,564,761 | A | * | 10/1996 | Mizuki et al. | 292/201 |
| 5,618,068 | A | * | 4/1997 | Mitsui et al. | 292/201 |
| 5,737,876 | A | * | 4/1998 | Dowling | 49/360 |
| 5,806,246 | A | * | 9/1998 | Azuma | 49/360 |
| 5,921,612 | A | * | 7/1999 | Mizuki et al. | 296/155 |
| 6,026,705 | A | * | 2/2000 | Ficyk et al. | 292/195 |
| 6,053,542 | A | * | 4/2000 | Ostrowski et al. | 292/201 |
| 6,168,216 | B1 | * | 1/2001 | Nakajima et al. | 292/201 |
| 6,341,448 | B1 | * | 1/2002 | Murray et al. | 49/280 |

FOREIGN PATENT DOCUMENTS

| | | |
|---|---|---|
| DE | 3907632 | 9/1990 |
| DE | 19546383 | 6/1996 |
| DE | 19607552 | 9/1996 |
| DE | 19604724 | 8/1997 |
| DE | 19828040 | 12/1999 |
| DE | 19933371 | 2/2000 |
| DE | 19843422 | 3/2000 |
| FR | 9802521 | 10/1999 |

* cited by examiner

*Primary Examiner*—J J Swann
*Assistant Examiner*—Thomas Y. Ho
(74) *Attorney, Agent, or Firm*—Martin A. Farber

(57) ABSTRACT

A door lock (12) which is conceived in particular for use in motor vehicle doors has a rotary latch (14) and a closing aid (10) which acts on the latter and, with the aid of a drive, carries along the door to be closed in to the closed position. Known door locks having a closing aid have an increased space requirement and cannot readily be accommodated in structurally predetermined constructional spaces. The invention provides the drive of the closing aid such that it is separated structurally from the door lock (12) and provides a flexible drive element for transmitting force from the drive to the rotary latch (14). If appropriate, a deflection roller (26) may be provided and may be designed such that it is movable in order to bring about an auxiliary opening.

6 Claims, 2 Drawing Sheets

DOOR LOCK HAVING A CLOSING AID

FIELD AND BACKGROUND OF THE INVENTION

The invention is concerned with a door lock, in particular for motor vehicles, having a rotary latch and a closing aid which acts on the latter and, with the aid of a drive, carries along the door to be closed over the last section into the closed position.

In the case of door locks of this type, there is the problem that the closing aid together with its drive considerably increases the space requirement of the door lock and therefore the door lock can no longer be used universally for various installation purposes, but instead complicated adaptations to the spatial conditions present in each case have to be undertaken, if installation is possible at all.

SUMMARY OF THE INVENTION

The object of the invention is to provide a door lock having a closing aid which can be adapted more easily to the given spatial installation conditions.

According to the invention, the object is achieved by a door lock of the type described at the beginning, in which the drive of the closing aid is separated structurally from the door lock and a flexible drive element is provided for transmitting force from the drive to the rotary latch.

The coupling of the closing aid, which is driven, for example, by an electric motor, to the door lock with the aid of a flexible drive element permits the door lock itself to be designed compactly, so that it can be used without substantial changes for a multiplicity of application purposes, even under restricted spatial conditions. The drive of the closing aid can be fitted independently of the door lock at a point in the relatively close vicinity of the door lock, in which case the length of the flexible drive element has merely to be adapted to the installation location of the drive.

The door lock according to the invention is therefore suitable not only for use in new structures, but may in principle also be installed, for example, into the cavities of existing structures of vehicle doors.

A further advantage of the flexible drive element resides in force being transmitted in a virtually loss-free manner and in its very diet manner of operating.

In a preferred development of the invention, provision is made for the rotary latch to be moveable into its closed position counter to the force of a restoring spring 58 by the flexible drive element in the form of a tension element.

Since the rotary latch is restored with the aid of the restoring spring 56 as is customary in door locks, it is sufficient if the closing aid is effective only in one direction of movement, in which case the drive element can be wound. A solution for this type of closing aid manages with very few parts and offers high degree of functional reliability.

The flexible drive element is preferably designed as a metal cable which, with a small cross section, enables the necessary tensile forces to be transmitted and offers good reliability against breakdown. In principle, however, it is also conceivable to use tension ties, belts, chains or the like as the flexible drive element.

The flexible drive element preferably undergoes a change in direction with the aid of at least one deflection roller, A deflection roller Of this type firstly facilitates the adaptation to difficult installation positions and secondly, in a preferred development of the invention, in which the deflection roller can be moved from its normal position into an auxiliary opening position shortening the path of the drive element, an auxiliary release is readily possible, even when the closing aid is activated. The deflection roller can be mounted on the door lock, on the drive of the closing aid or, independently of both of these, on the door structure If the deflection roller has an appropriate path of movement, the drive of the closing aid does not even have to be switched off, in which case the auxiliary release of course not only causes yielding by the deflection roller being pivoted away or inward, but at the same time causes release of the rotary latch which, under some circumstances, has already engaged in the preliminary catch or main catch.

In a particularly preferred embodiment of the invention, the moveability of the deflection roller into the auxiliary opening position is effected by the deflection roller being arranged on a toggle lever which can folded in by actuation of the auxiliary opening device. The advantage of a toggle lever structure resides in said toggle lever in the stretched state being virtually infinitely stiff, on the one hand, and thereby enabling the transmission even of high closing forces, and secondly, being moveable beyond a dead center position, by a comparatively small actuating force being exerted at the buckling point, after which the toggle lever immediately folds in, when a load is applied to the deflection roller, and ensures the necessary release of the drive element. A restoring spring 56 ensures that after an auxiliary triggering the toggle lever automatically returns back into its stretched position.

In order to ensure satisfactory functioning of the closing aid, it is expedient to keep the drive element under stress in all operating states by at least one prestressting spring. In this case, the prestressing spring has to be capable of keeping the drive element under a sufficient tensile stress even during an auxiliary release and corresponding shortening of the path of the drive element, in order, for example, to ensure that the flexible drive element cannot spring away from the deflection roller.

In the simplest case, the restoring spring of the rotary latch can ensure that the drive element is prestressed, but this preferably takes place by means of a restoring spring of a driving lever acting on the rotary latch. As an alternative, it is conceivable to provide the prestress with the aid of a resiliently mounted drive roller, a deflection roller acting in its normal position as a clamping roller or else with the aid of a drive element which can be extended in the longitudinal direction. Combinations of a number of these prestressing elements are likewise conceivable,

BRIEF DESCRIPTION OF THE DRAWINGS

An exemplary embodiment of the invention will be discussed in more detail below with reference to the attached drawings, in which.

DETAILED DESCRIPTION OF THE PREFERRED EMBODIMENT

Figure 1:
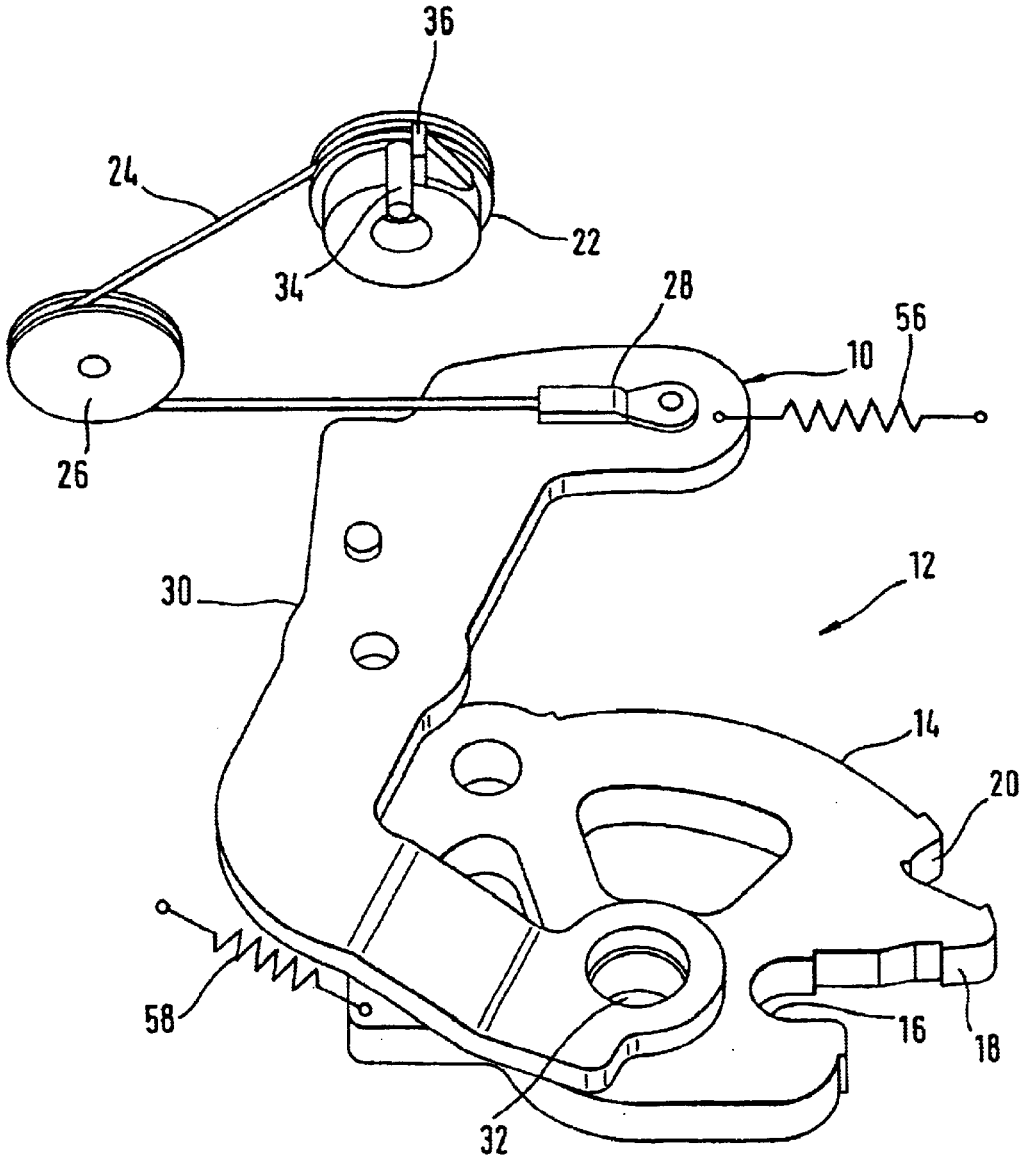
FIG. 1 shows a schematic illustration of a closing aid acting on a rotary latch of a door lock.

In FIG. 1, a closing aid 10 of a door lock 12 is illustrated schematically, in which case, for the purpose of simplification, only a rotary latch 14 of the door lock is illustrated and the latching arrangement and further devices which may be present have been omitted.

The rotary latch 14 has a receiving opening 16, which interacts with a closing lug or a closing clip, and a main catch 18 and a preliminary catch 20 which, in interaction with detent pawl (not illustrated), ensure that the rotary latch 14 is retained in its closed position or preliminary latching position. The rotary latch 14 is preloaded in the direction of its open position with the aid of a prestressing spring 56 which is designed, for example, as a torsion spring.

The closing aid 10 is activated with the aid of a microswitch (not illustrated) as soon as the rotary latch 14 has passed into its preliminary latching position defined by the preliminary catch 20. In the process, an electric drive motor is activated which, in accordance with the cable winch principle, drives a cable winch 22 on which a flexible metal cable 24 is wound. The metal cable 24 is deflected with the aid of a deflection roller 26 and acts on a driving lever 30 via a cable clamp 28, the cable clamp 28 being fastened in an articulated manner on the driving lever 30. The driving lever 30 in turn is mounted such that it can pivot about the axis of rotation 32 of the rotary latch 14 and carries the rotary latch 14 along (in a manner which is not illustrated in more detail) from its preliminary latching position into the closed position or main latching position.

The drive, which can move in both directions or else is designed as a planetary gear system, together with the cable winch 22 is designed such that it is separated structurally from the chassis of the actual door lock 12 and can be fitted to a suitable location on the door, the deflection roller 26 ensuring exact guidance of the cable parallel to the pivoting plane of the driving lever 30. A pin 34 is provided as a limiting element on the cable winch 22, which pin, after the closed position of the rotary latch 14 is reached, runs against a positionally fixed stop 36, after which the electric drive motor is switched off, for example by detecting the rise in load current. If appropriate, further deflection rollers may be used should this be necessary on account of structural conditions. Instead of the metal cable 24, the use of other flexible drive elements, for example of ties, belts or chairs, is also conceivable.

The driving lever 30 is actuated with the aid of the metal cable 24 against the load of a prestressing spring, the prestressing spring returning the driving lever 30 into its starting position when the rotary latch 14 is opened and, in the process, also correspondingly unwinding the metal cable 24 from the cable winch 22. The metal cable 24 is, in all operating states, under a certain prestress which can be applied either by the prestressing spring of the driving lever 30, by a resiliently mounted cable winch 22 or by a deflection roller 26 acting as a tensioning roller. The restoring spring of the rotary latch 14 can also be used for applying a tensioning force in the metal cable 24, in which case combinations of a number of the previously described prestressing options are also conceivable.

Figure 2:
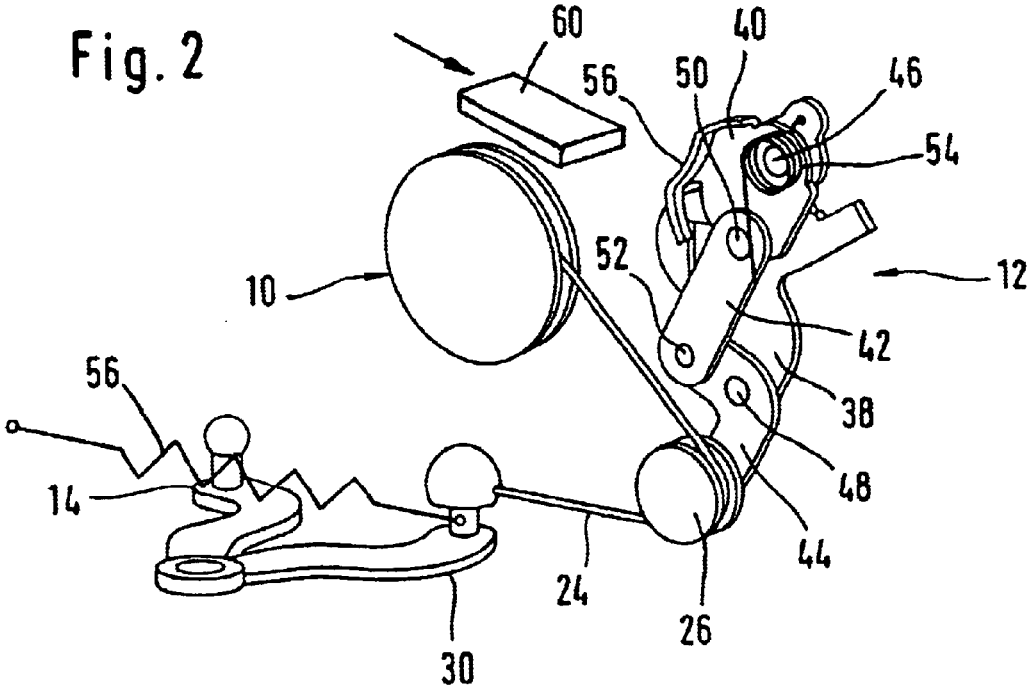
FIG. 2 shows a door lock similar to FIG. 1 having a deflection roller mounted on a toggle lever in the normal position.

In FIG. 2, a preferred development of the door lock 12 is illustrated, in which case, for reasons of clarity, components whose functions correspond to those components of the design according to FIG. 1 are provided with the same reference numbers in each case.

In contrast to the simplified embodiment of the door lock 12 which is illustrated in FIG. 1, in the embodiment illustrated in FIG. 2 provision is made for the deflection roller 26 to be mounted at the free end of a toggle lever 38. The toggle lever 38 comprises a first member 40, a second member 42 and a third member 44, the first member 40 and the third member 44, on which the deflection roller 26 is mounted rotatably, being mounted such that they can pivot about axes of rotation 46, 48 which are fixed with respect to each other. The second member 42 is articulated on the first member 40 via a first pivot spindle 50 and on the third member 44 Via second pivot spindle 52. A torsion spring 54 keeps the toggle lever 38 in its stretched position, so that the deflection roller 26 remains in its normal position irrespective of the forces acting through the metal cable 24 when the closing aid is actuated. Satisfactory functioning of the closing aid is therefore ensured.

However, the toggle lever 38 offers the option of auxiliary opening of the door lock 12 even when the door-closing aid is activated. For this purpose, there is provided on the first member 40 an actuating surface 56 on which a part (not shown) which is connected to the door-opening mechanism and/or to a special auxiliary release acts. As soon as the first member 40 and the second member 42 which is connected thereto have been moved beyond a dead center position, the toggle lever 38 buckles into the auxiliary opening position illustrated in FIG. 3, in which case the deflection roller 26 pivots in the direction of the cable winch 22 shortening the path of the metal cable 24. in the process, the tensile forces acting in the metal cable 24 assist the folding-in movement of the toggle lever 38. The shortening of the path of the metal cable causes the driving element 30 to move out of an engagement region with the rotary latch 14, with the result that the latter is completely uncoupled from the closing aid and the release of the rotary latch 14 is not hindered by the driving lever 30. Consequently, the door can be opened even with the drive motor of the closing aid not being interrupted, in which case it will generally spring open automatically on account of the opening rotary latch 14 and the prestressing force of the sealing rubber in the door frame.

Figure 3:
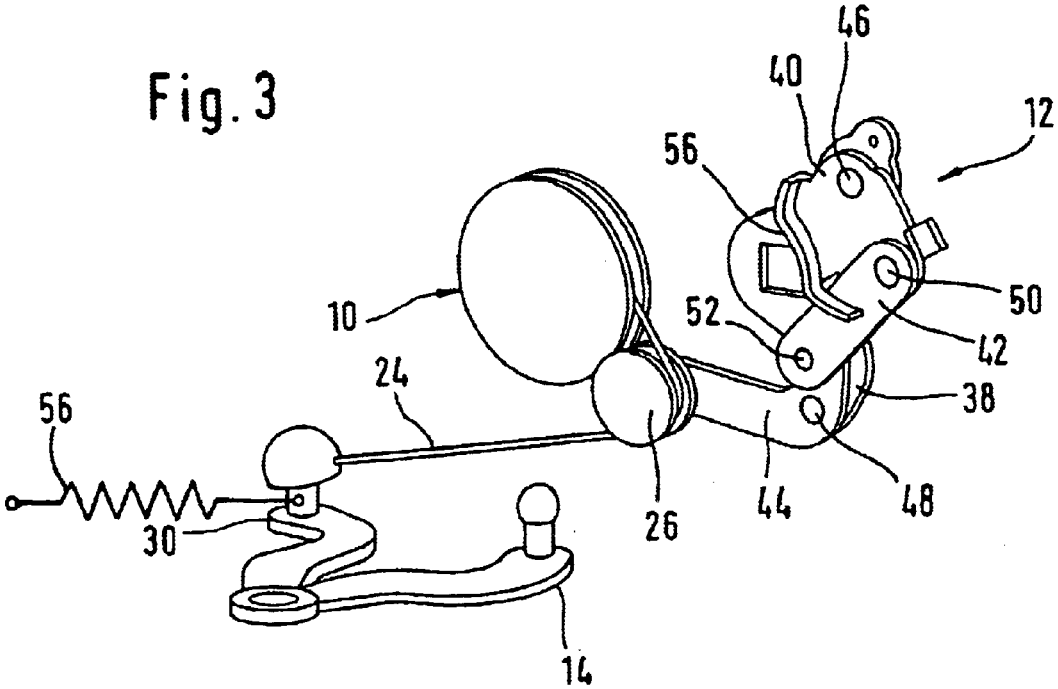
FIG. 3 shows the device according to FIG. 2 with the toggle lever folded in in an auxiliary opening position.

The prestressing path of the prestressing spring of the driving lever 30 is dimensioned in such a manner that even in the auxiliary opening position according to FIG. 3 there is still always a sufficient spring deflection in order also to keep the metal cable 24 in this position under prestress.

On the other hand, the torsion spring 54 makes it possible to move the toggle lever 38 back into its stretched position counter to the load of the prestressing force of the driving lever 30 when the opening process is finished and only the prestressing forces of the prestressing spring of the driving lever 30 are still active in the metal cable 24.

The toggle lever 38 together with the deflection roller 26 can either be arranged on the housing of the door lock 12 in order to form a module; but it is also conceivable, depending on spatial conditions, to mount the unit comprising the toggle lever and deflection roller 26 on a common chassis together with the cable winch 22 or to provide a mounting point which is independent of the cable winch 22 and the door lock 12. In addition to the already mentioned advantage of the free spatial design, the cable drive of the closing aid also offers the advantage of a quiet and virtually loss-free transmission of force.

The door lock 12 described can also readily be provided with an opening aid possibly operating with a separate drive motor, without structural changes being necessary in the region of the closing aid.

We claim:

1. A door lock for motor vehicles having a rotary latch (14) and a closing aid (10) which acts on the latter and, with aid of a drive, carries along a door to be closed over a last section into closed position, wherein the drive of the closing aid (10) is separated structurally from the door lock (12) and a flexible drive element (24) is provided for transmitting force from the drive to the rotary latch (14), wherein the flexible drive element undergoes a change in direction with aid of at least one deflection roller (26), wherein the deflection roller (26) is rotatably mounted on a toggle lever (38) and is moveable from its normal position by the toggle lever into an auxiliary opening position shortening path of the drive element, wherein the toggle lever (38) is foldable in by actuation of an auxiliary opening device to displace the rotational axis of the deflection roller (26) during movement of the deflection roller by the toggle lever.

2. The door lock as claimed in claim 1, wherein the rotary latch (14) is moveable into its closed position counter to force of a restoring spring by the flexible drive element in form of a tension element.

3. The door lock as claimed in claim 1, wherein the drive drives a cable winch or a cable eccentric (22) onto which the drive element is windable.

4. The door lock as claimed in claim 1, wherein the flexible drive element is a metal cable (24).

5. The door lock as claimed in claim 1, wherein the drive element is kept under stress in all operating states by at least one prestressing spring.

6. The door lock as claimed in claim 5, wherein at least a restoring spring of the rotary latch and/or a restoring spring of a driving lever (30) acting on said rotary latch ensures that the drive element is prestressed.

* * * * *